US008140274B2

(12) United States Patent
Gagel et al.

(10) Patent No.: US 8,140,274 B2
(45) Date of Patent: Mar. 20, 2012

(54) METHOD AND DEVICE FOR DETERMINING THE EFFECTIVE DELIVERY RATE OR ADJUSTING THE SPEED OF A PERISTALTIC PUMP

(75) Inventors: Alfred Gagel, Litzendorf (DE); Daniel Hendreich, Rheinstetten (DE); Roland Ollinger, Karlsruhe (DE); Ralf Wamsiedler, Gochsheim-Weyer (DE)

(73) Assignee: Fresenius Medical Care Deutschland GmbH, Bad Homburg (DE)

( * ) Notice: Subject to any disclaimer, the term of this patent is extended or adjusted under 35 U.S.C. 154(b) by 868 days.

(21) Appl. No.: 11/886,377

(22) PCT Filed: Mar. 2, 2006

(86) PCT No.: PCT/EP2006/001890

§ 371 (c)(1),
(2), (4) Date: Jun. 6, 2008

(87) PCT Pub. No.: WO2006/097199

PCT Pub. Date: Sep. 21, 2006

(65) Prior Publication Data

US 2009/0234289 A1 Sep. 17, 2009

(30) Foreign Application Priority Data

Mar. 15, 2005 (DE) ..... 10 2005 011 625
May 20, 2005 (DE) ..... 10 2005 023 430

(51) Int. Cl.
*G01F 1/00* (2006.01)

(52) U.S. Cl. ..... 702/45; 702/50; 702/55; 702/100

(58) Field of Classification Search ..... 702/45, 702/50, 100
See application file for complete search history.

(56) References Cited

U.S. PATENT DOCUMENTS

| | | | | |
|---|---|---|---|---|
| 5,336,052 | A * | 8/1994 | Zollner et al. | 417/20 |
| 5,641,405 | A * | 6/1997 | Keshaviah et al. | 210/645 |
| 5,733,257 | A | 3/1998 | Sternby et al. | |
| 6,347,516 | B1 * | 2/2002 | Bolz et al. | 60/431 |
| 6,604,908 | B1 * | 8/2003 | Bryant et al. | 417/26 |
| 2005/0043665 | A1 | 2/2005 | Vinci et al. | |

OTHER PUBLICATIONS

Wu et al., "Modeling, Estimation and Control of Cardiovascular Systems with a Left Ventricular Assist Device", Jun. 8, 2005, 2005 American Control Conference, pp. 3841-3846, 0-7803-9098-9.*
International Search Report (ISR) from PCT/EP2006/001890.
English translation of International Preliminary Report on Patentability from PCT/EP2006/001890.

* cited by examiner

*Primary Examiner* — Drew A Dunn
*Assistant Examiner* — Mischita Henson
(74) *Attorney, Agent, or Firm* — Kenyon & Kenyon LLP

(57) ABSTRACT

A method and a device for determining the effective delivery rate of a peristaltic pump with which a liquid is delivered inside an elastic hose pipe or for adjusting the speed of a peristaltic pump in order to match the effective delivery rate of the pump to the desired delivery rate may be characterized in that the effective delivery rate is calculated based on the nominal speed of the pump and the pressure inside the hose pipe upstream of the pump depending on the running time of the pump. The stroke volume of the pump may be multiplied by the nominal speed of the pump and the product from the stroke volume and the speed of the pump may be corrected by a correction function, thereby determining the effective delivery rate of the pump.

30 Claims, 2 Drawing Sheets

METHOD AND DEVICE FOR DETERMINING THE EFFECTIVE DELIVERY RATE OR ADJUSTING THE SPEED OF A PERISTALTIC PUMP

FIELD OF THE INVENTION

The present invention relates to a method and a device for determining the effective delivery rate of a peristaltic pump, with which liquid is delivered in an elastic hose pipe. Furthermore, the present invention relates to a method and a device for adjusting the speed of a peristaltic pump, with which liquid is delivered in an elastic hose pipe.

BACKGROUND OF THE INVENTION

In medical technology, peristaltic or occluding pumps may be used for reasons of sterility. Various designs of peristaltic pump are known, one of which is the roller pump. All peristaltic pumps have in common the fact that an elastic hose pipe is inserted into the pump, in which the liquid to be delivered flows.

The known extracorporeal blood treatment apparatuses are a particular area of application of peristaltic pumps in medical technology, said blood treatment apparatuses including for example hemodialysis apparatuses, hemofiltration apparatuses and hemodiafiltration apparatuses.

Great demands are made on the delivery accuracy of peristaltic pumps in medical technology, for example with extracorporeal blood treatment apparatuses. It is a drawback that the effective delivery rate of a peristaltic pump, which is typically adjusted at a preset nominal speed of the pump, depends on a large number of factors. From the nominal speed of the pump, therefore, it is not readily possible to draw conclusions about its effective delivery rate.

The properties of the hose pipe represent one of the main factors from which the delivery rate of a peristaltic pump depends. It has been shown in practice that a deformation of the elastic hose leads to a change in the delivery rate of the pump.

German patent document DE 197 47 254 C2 describes a method for the non-invasive internal pressure measurement in elastic hose pipes. The document points out that the properties of the hose pipe change with time.

There is known from U.S. Pat. No. 6,691,047 a method for calibrating a peristaltic pump for an extracorporeal blood treatment apparatus, whereby the pressure in the hose pipe is measured upstream of the pump before the start of the blood treatment, in order to be able to predict the pressure upstream of the pump in the course of the treatment. The pump is calibrated at a pressure which corresponds to the average value of the previously measured pressure.

U.S. Pat. No. 4,715,786 describes a method for calibrating a peristaltic pump, but without taking account of a dependence of the delivery rate on time.

PCT publication WO 99/23386 describes a method for controlling the speed of peristaltic pumps as a function of the pressure in the hose pipe upstream of the pump. The control takes place on the basis of the physical properties of the hose pipe and the pump, but once again without taking account of the dependence on time.

There is known from U.S. Pat. No. 5,733,257 a calibration method for peristaltic pumps, wherein the dependence of the delivery rate on time is negated, in that the calibration does not take place until after the lapse of a preset duration. It is assumed that the delivery rate after the lapse of this duration no longer changes with time.

The method described in European patent document EP 0 513 421 A1 for determining the blood flow during an extracorporeal blood treatment likewise does not take account of the time-related change in the delivery rate with the running time of the pump.

SUMMARY OF THE INVENTION

An aspect of the invention is to make available a method and a device for determining the effective delivery rate of a peristaltic pump with a high degree of accuracy. Moreover, an aspect of the invention is to specify a method and a device for adjusting the speed of a peristaltic pump with a high degree of accuracy, in order to match the effective delivery rate to the desired delivery rate.

The example methods according to the present invention and the device according to the present invention for determining the effective delivery rate of a peristaltic pump are based on the fact that, in order to achieve a particularly good accuracy, the effective delivery rate takes place not only on the basis of the nominal speed of the pump and the pressure in the hose pipe upstream of the pump, but also in dependence on the running time of the pump.

In an example embodiment, the product of a preset stroke volume of the pump and the nominal speed of the pump is corrected with a correction function in order to determine the effective delivery rate, said correction function describing the dependence of the stroke volume of the pump on the running time and the pressure in the hose pipe upstream of the pump. The preset stroke volume of the pump operated pressureless is determined by the mechanical dimensions of the pump, for example its radius, its length etc. and the dimensions of the hose pipe.

As a correction function, it may be beneficial for a polynomial with one or more parameters to be set up to describe the relative decrease in the nominal delivery rate with the running time of the pump and for a polynomial with one or more parameters to be set up to describe the relative decrease in the nominal delivery rate with the pressure in the hose pipe upstream of the pump. The polynomial degrees may be increased by adding further powers or reduced by equating parameters to zero. The independence of the individual variables may also be removed, the parameters of the one variable then being made dependent on at least another variable.

The correction function with the parameters is generally a property of the pump segment. The stroke volume and the parameters may thus be ascertained in tests and be preselected for the user of the pump. The same applies to the preset stroke volume.

The example device according to the present invention for determining the effective delivery rate has means for measuring the pressure in the hose pipe upstream of the pump, means for determining the nominal speed of the pump and means for calculating the effective delivery rate of the pump on the basis of the nominal speed of the pump and the pressure in the hose pipe upstream of the pump in dependence on the running time of the pump.

In an example embodiment, the device for calculating the effective delivery rate comprise a means for multiplying the preset stroke volume by the nominal speed of the pump and means for correcting the product of the stroke volume and the nominal speed. The means for correction may be configured as a computing unit. For example, the required calculations may take place with a computer.

According to the example methods according to the present invention and the example devices according to the present invention for adjusting the speed of a peristaltic pump, with which liquid is delivered in an elastic hose pipe, the matching of the effective delivery rate of the pump to the desired delivery rate may take place not only on the basis of the nominal speed of the pump and the pressure in the hose pipe upstream of the pump, but also in dependence on the running time of the pump.

In principle, it may be possible with the example methods and devices according to the present invention to determine the effective delivery rate to be expected at a nominal speed of the pump, whereby the effective delivery rate may be compared with the desired delivery rate. Since the effective delivery rate may be lower than the desired delivery rate, the speed of the pump may be increased until the effective delivery rate corresponds to the desired delivery rate. A comparison between the setpoint value and the actual value may be possible with the example methods and devices according to the present invention in order to determine the effective delivery rate without the effective delivery rate being measured.

In an example embodiment of the present invention, the matching of the effective delivery rate of the pump to the desired delivery rate first takes place in an initial compensation step. It is assumed, according to this example, that the effective delivery rate for the most part corresponds to the desired delivery rate after the performance of this compensation step. After performance of the initial compensation step, the remaining deviation of the delivery rate of the pump may then be eliminated by control. The regulation of the pump may take place in continuous iterative compensation steps.

A new speed with which the pump is operated in order to match the effective delivery rate to the desired delivery rate may be calculated in the initial compensation step by multiplication of the nominal speed of the pump adjusted before the compensation step by a correction factor.

In order to determine the correction factor, the pump may be operated at a preset speed, whereby the pressure that is established at the preset speed is measured in the hose pipe upstream of the pump. The preset speed, with which the pump is operated in order to determine the pressure in the hose pipe, may simply be calculated according to an equation.

The correction factor may be calculated from the measured pressure which is established upstream of the pump in the hose pipe at the preset speed, according to an equation into which, apart from the pressure in the hose pipe upstream of the pump, one or more parameters enter that describe the relative decrease in the delivery rate with the running time of the pump and one or more parameters enter that describe the relative decrease in the delivery rate with the underpressure in the hose pipe upstream of the pump.

The equation describing the relationship between the pressure in the hose pipe upstream of the pump and the correction factor may, in principle, be solved in real time. It may be beneficial, however, that the individual pairs of values of pressure and correction factor are stored in a memory, so that access to the data is possible in real time, but without the equation having to be solved. The hardware and software expenditure for the determination of the correction factor may thus be reduced.

The initial compensation step may take place after the starting of the pump or the adjusting of a new setpoint delivery rate. In further compensation steps, deviations of the effective delivery rate of the pump from the desired delivery rate may be continuously compensated for. The correction is achieved in the initial compensation step. Only smaller deviations are generally eliminated in the following control.

A maximum speed or delivery rate, for example relative to an initial start value, may be taken into account as an upper threshold value in the regulation of the delivery rate of the pump. An upper threshold value for the amount of the pressure upstream of the pump may also be provided. If the individual magnitudes reach the upper threshold values, this may be used as an indication of the fact that the effective delivery rate can no longer be matched to the desired delivery rate. In this case, it is possible to emit an optical and/or acoustic alarm which draws the user's attention to the deviation in delivery rate.

In principle, the regulation only has to be carried out when the amount of the deviation in the delivery rate lies above a preset lower threshold value. For example, further matching of the effective delivery rate to the desired delivery rate is not in general necessary in the case of a deviation of the delivery rate of less than one percent.

Some embodiments make provision such that the preset stoke volume of the pump and the individual parameters for determining the correction factor for the various hose systems are made available, so that the appropriate stroke volume and the respective parameters may be preset by selecting the hose system.

Moreover, some embodiments of the present invention relate to a blood treatment apparatus with a device for determining the effective delivery rate of a peristaltic pump and/or for adjusting the speed of the peristaltic pump, in order to be able to deliver liquid in an elastic hose pipe exactly at a desired delivery rate.

Various example embodiment of the invention are explained in greater detail below by reference to the drawings.

DETAILED DESCRIPTION

Figure 1:
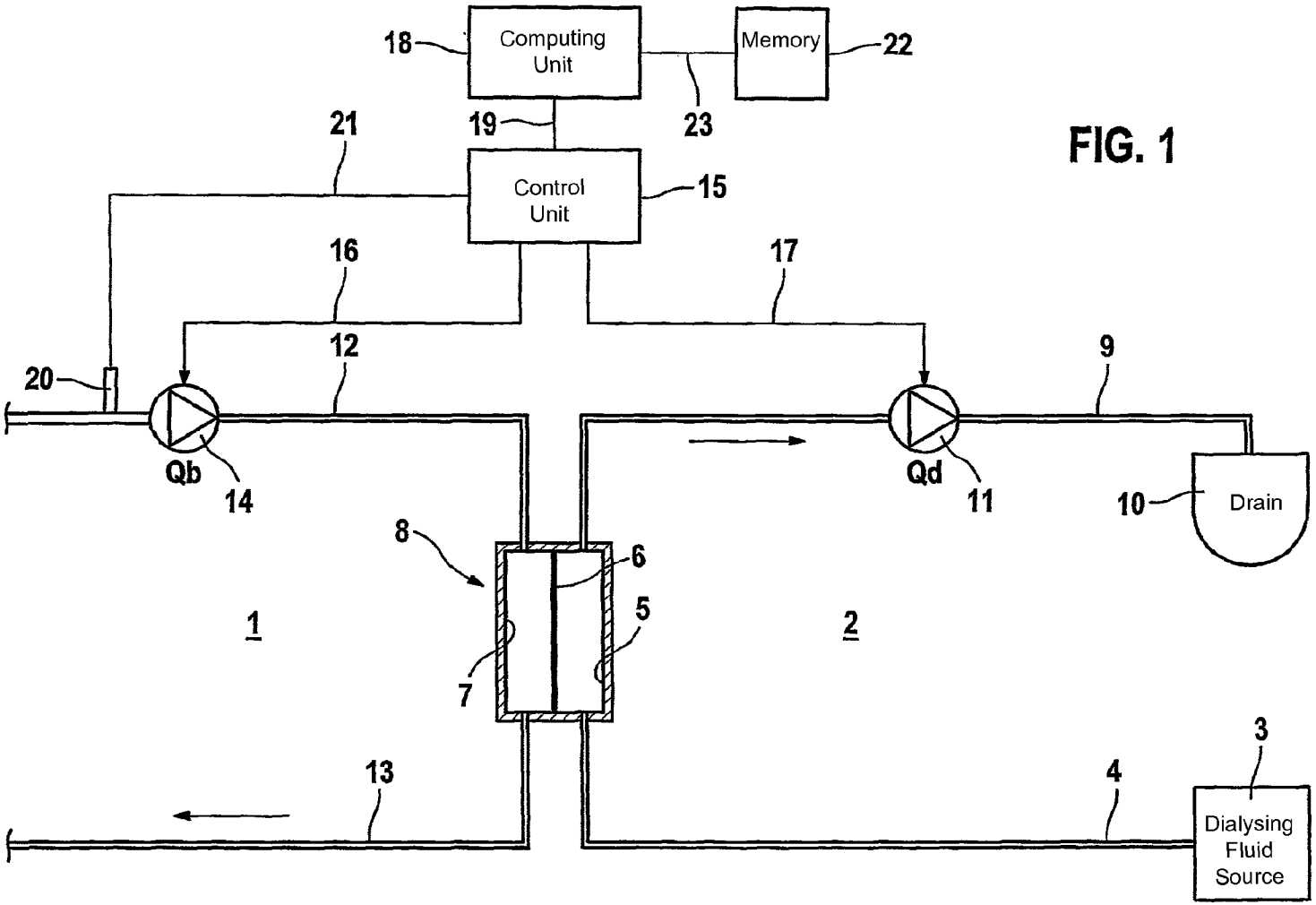
FIG. 1 shows a general schematic representation of an extracorporeal blood treatment apparatus together with a device for determining the effective delivery rate of the peristaltic pump of the blood treatment apparatus and a device for adjusting the speed of the pump, in order to deliver the liquid at a desired delivery rate.

FIG. 1 shows, in a general schematic representation, the main components of an extracorporeal blood treatment apparatus, for example a hemodialysis apparatus, which includes an extracorporeal blood circuit 1 and a dialysing fluid circuit 2. Dialysing fluid flows from a dialysing fluid source 3 through a dialysing fluid supply line 4 into a dialysing fluid chamber 5 of a dialyser 8 divided by a semipermeable membrane 6 into dialysing fluid chamber 5 and a blood chamber 7, whilst dialysing fluid flows out of dialysing fluid chamber 5 of dialyser 8 via a dialysing fluid discharge line 9 into a drain 10. A dialysing fluid pump 11 is disposed in dialysing fluid discharge line 9.

The patient's blood flows via a blood supply line 12 into blood chamber 7 and out of chamber 7 of dialyser 8 via blood discharge line 13 back to the patient. The blood pump 14 is disposed in blood supply line 12. Both dialysing fluid pump 11 and blood pump 14 are peristaltic pumps, in particular roller pumps. Blood supply and discharge lines 12, 13 and dialysing fluid supply and discharge lines 4, 9 may be elastic hose pipes made of plastic, which are made available as disposables for single use especially on the blood side and are inserted into the pumps. It is, however, also possible for the hoses to be part of a cassette-like module, from which the hose-side pump segment projects in the form of a loop.

The blood treatment apparatus includes a control unit 15, which is connected via control lines 16, 17 to blood pump 14 and dialysing fluid pump 11. The dialysis apparatus further includes computing unit 18, which communicates via a data line 19 with control unit 15.

The hemodialysis apparatus also has other components, which are generally known to the person skilled in the art and, for the sake of clarity, are not represented.

The device according to the present invention and the method for determining the effective delivery rate of blood pump 14 and for adjusting the speed of the blood pump are described in detail below. Corresponding devices may also be provided for dialysing fluid pump 11.

The present invention is based on the properties of blood pump 14 with respective hose pipe 12, which is inserted into the blood pump, described as follows.

Effective blood flow $Q_{b,ist}$ of blood pump 14 is calculated according to the following equation:

$$Q_{b,ist}=n*V_S \qquad \text{equation (1)}$$

where n is the rotor speed of the blood pump [1/min], and Vs is the stroke volume with a revolution of the blood pump [ml].

It is assumed that stroke volume Vs of blood pump 14 is a function of the mechanical dimensions r [mm] of the blood pump and the hose, running time t [h] of the blood pump, and pressure $P_{art}$ [mmHg] in blood supply line 12 upstream of the blood pump:

$$V_S=V_S(r,t,P_{art}) \qquad \text{equation (2)}$$

where r represents the mechanical dimensions and tolerances of the blood pump [mm], t is the running time of the blood pump [h], and $P_{art}$ is underpressure at the entrance of the blood pump [mmHg].

Apart from the running time of the pump, its speed or cycle number in particular is of interest in practice, which is directly proportional to the loading of the pump segment and is responsible for the plastic behaviour of the hose. With a constant delivery rate, however, this difference may be less relevant. If, however, the delivery rate is changed at different times, this may have an effect. Variable t may therefore not only be the running time, but also a parameter in an unequivocal relationship therewith, for example the accumulated speed of the pump. Instead of the running time of the pump, the number of revolutions of the pump determined, for example, with a Hall sensor may also be taken into account.

The stroke volume of the blood pump as a function of pressure $P_{art}$ upstream of the pump in hose pipe 12 and running time t of the pump is described by the following equation:

$$V_S=V_{S,0}(r)*(1-a_1*t)*(1-b_1*P_{art}-b_2*P^2_{art}) \qquad \text{equation (3)}$$

where $V_{S,0}(r)$ is stroke volume [ml] after a preset run-up time $t_0$ with zero pressure at the entrance of the blood pump, $a_1$ is a parameter [%/h] which describes the relative decrease in the delivery rate with the running time, and $b_1$ and $b_2$ are parameters [%/mm $Hg^2$] which describe the relative decrease in the delivery rate with the arterial underpressure.

Preset stroke volume $V_{S,0}(r)$ [ml] after a preset run-up time to of the blood pump of, for example, 5 min with an underpressure at the entrance of the pump of 0 is determined by the mechanical dimensions of the pump and of the hose.

Since many types of hose exhibit a deviation from the linear time-related behavior according to equation (3), which after a few minutes running time may be neglected, it is a tried and tested practice to determine preset stroke volume $V_{S,0}(r)$ for this time. On account of the short run-up time, the deviation of the actual pump rate for this period is also negligible. In principle, however, it is also possible to specify preset stroke volume $V_{S,0}(r)$ without run-up effects, if this is not necessary due to the employed functional time-related relationship of the correction factor.

Parameter $a_1$ describes the relative decrease in the delivery rate of the pump with running time t, while parameters b1 and b2 describe the relative decrease in the delivery rate with the underpressure. The preset stroke volume and the individual parameters are magnitudes which are characteristic of the blood pump used together with the hose pipe, said magnitudes being ascertained in tests and made available to the user.

The nominal delivery rate (blood flow) $Q_{b,0}$ [ml/min] after the preset running time of, for example, 5 min at a zero pressure at the entrance of the pump, is obtained according to the following equation:

$$Q_{b0}=n_{alt}*V_{s,0}(r) \qquad \text{equation (4)}$$

Effective delivery rate $Q_{b,ist}$ (blood flow) of the blood pump that is to be expected when the pump is operated at speed n is obtained according to the following equation:

$$Q_{b,ist}=n*V_{S,0}(r)*(1-a_1*t)*(1-b_1*P_{art}-b_2*P^2_{art}) \qquad \text{equation (5)}$$

Figure 2:
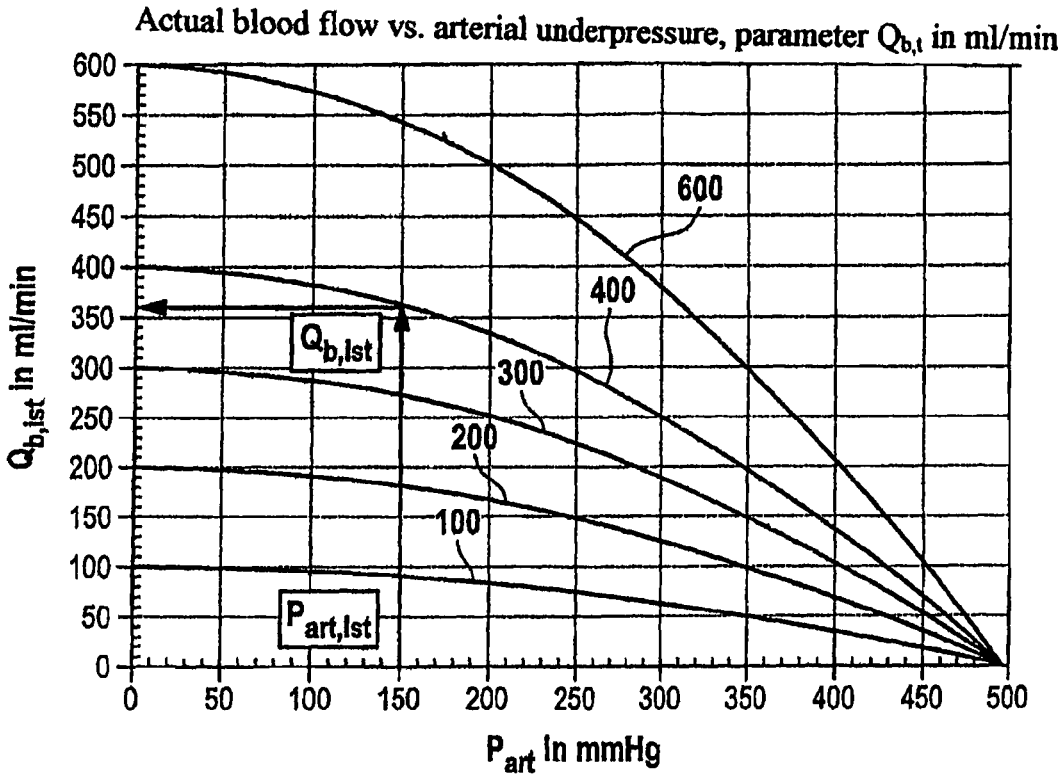
FIG. 2 shows the effective delivery rate of the pump as a function of the pressure upstream of the pump for various delivery rates and FIG. 3 shows the dependence of the effective delivery rate of the pump on the pressure upstream of the pump for various speeds of the pump.

FIG. 2 shows the dependence of effective delivery rate $Q_{b,ist}$ on the pressure upstream of the blood pump for different delivery rates $Q_{b,t}$. It is clear that the delivery rate decreases with increasing arterial underpressure. The higher the delivery rate (blood flow), the greater the absolute decrease.

The device according to the invention for determining the effective delivery rate of blood pump 14 includes means for measuring the pressure in hose pipe 12 upstream of blood pump 14 in the form of a pressure sensor 20, which may case present in the known blood treatment apparatuses. Blood sensor 20 is connected via a data line 21 to control unit 15. Moreover, means are provided for determining the nominal speed of blood pump 14, which are a component of control unit 15 of the dialysis apparatus inasmuch as control unit 15 presets a specific speed for blood pump 14. The same applies to dialysing fluid pump 11.

When control unit 15 for blood pump 14 presets a specific speed n, the blood pump delivers the blood at an effective delivery rate $Q_{b,ist}$ (blood flow). The measured value of the arterial underpressure from pressure sensor 20 and speed n of blood pump 14 from control unit 15 are available at computing unit 18. Furthermore, parameters a1, b1 and b2, as well as stroke volume $V_{S,0}(r)$, are available at the computing unit. These empirically determined magnitudes are stored in a memory 22, which is connected via a data line 23 to computing unit 18.

According to equation (5), computing unit 18 calculates effective delivery rate $Q_{b,ist}$ (blood flow) which is established at preset speed n of blood pump 14. Since it is to be expected that the effective delivery rate will be smaller than the desired delivery rate, control unit 15 increases speed n of blood pump 14 until the effective delivery rate corresponds to desired delivery rate $Q_{b,soll}$.

The device and the method for matching the effective delivery rate of the blood pump to the desired delivery rate by adjusting the speed of the pump are described in detail below.

The control of the speed of the blood pump begins with an initial compensation step, which may be carried out immediately after starting the pump. A further compensation then follows, which may take place continuously or iteratively. If the setpoint delivery rate is to be changed, the initial compensation step takes place again, but parameter t is not reset. In this way, the time-related influence on the delivery rate may also be taken into account with a change in the delivery rate.

Control unit 15 first sets blood pump 14 at a preset speed, which is calculated in the computing unit according to the following equation $$n_{alt} = \frac{Q_{b,soll}}{V_{S,0}(r) * (1 - a_1 * t)} \quad \text{equation (6)}$$

At speed $n_{alt}$, preset by the control unit, arterial underpressure $P_{art,alt}$ is established, which is measured by pressure sensor 20.

Figure 3:
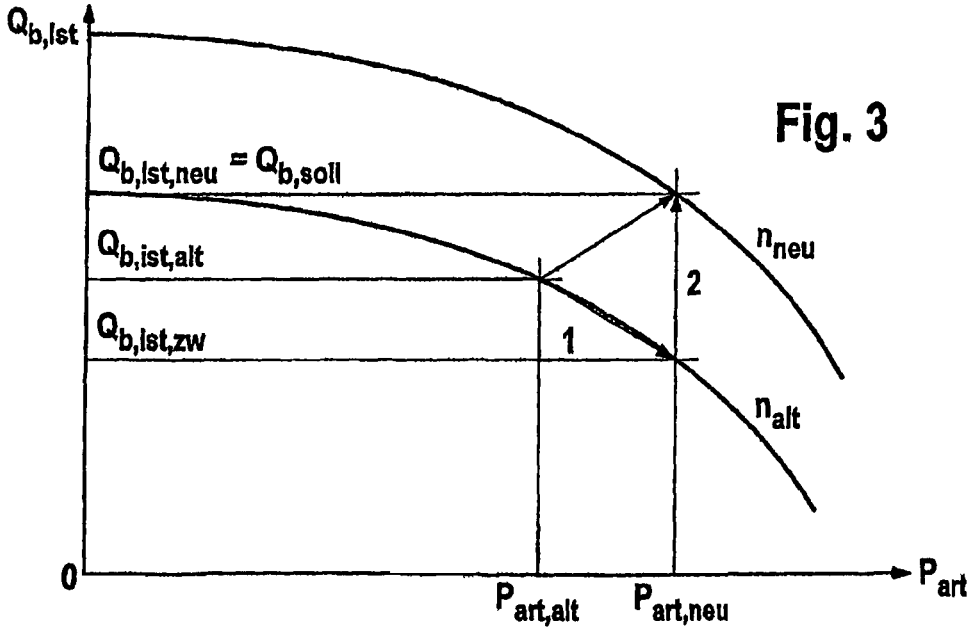

FIG. 3 shows delivery rate (blood flow) $Q_{b,ist}$ of blood pump 14 as a function of arterial underpressure $P_{art}$. Effective delivery rate $Q_{b,ist,alt}$ to be expected is obtained at measured underpressure $P_{art,alt}$ according to equation (5). In the initial compensation step, control unit 15 increases speed n in order to compensate for the delivery deviation.

On account of new speed $n_{neu}$, the arterial pressure of $P_{art,alt}$ changes to $P_{art,neu}$. Pressure change $\Delta P_{art}$ is fixed proportional to speed change $\Delta n$.

$$\begin{aligned} \frac{P_{art,neu}}{P_{art,alt}} &= \frac{n_{neu}}{n_{alt}} \\ &= 1 + \frac{\Delta n}{n_{alt}} \\ &= x \end{aligned} \quad \text{equation (7)}$$

where x is a correction factor.

With new arterial underpressure $P_{art,neu}$, new stroke volume $V_{S,neu}$ is obtained:

$$V_{S,neu} = V_{S,0}(r) * (1 - a_1 * t) * (1 - b_1 * P_{art,neu} - b_2 * P^2_{art,neu}) \quad \text{equation (8)}$$

With new stroke volume $V_{S,neu}$, delivery rate $Q_{b,ist,zw}$ would result at previous speed $n_{alt}$:

$$Q_{b,ist,zw} = n_{alt} * V_{S,neu} \quad \text{equation (9)}$$

The new expected value of the blood flow $Q_{b,ist,neu}$ results from new speed $n_{neu}$ and current stroke volume $V_{S,neu}$ with:

$$Q_{b,ist,zw} = Q_{b,soll} = n_{neu} * V_{S,neu} \quad \text{equation (10)}$$

where the new expected value of the blood flow is set equal to setpoint value $Q_{b,soll}$. Hence:

$$\begin{aligned} \frac{Q_{b,soll}}{Q_{b,ist,zw}} &= \frac{n_{neu} * V_{S,neu}}{n_{alt} * V_{S,neu}} \\ &= \frac{n_{neu}}{n_{alt}} \\ &= x \end{aligned} \quad \text{equation (11)}$$

If equations (7), (8), (9) are put into equation (11), the following equation is obtained:

$$\frac{Q_{b,soll}}{n_{alt} * V_{S,0}(r) * (1 - a_1 * t)} = x - b_1 * P_{art,alt} * x^2 - b_2 * P^2_{art,alt} * x^3 \quad \text{equation (12)}$$

According to equation (6), the left-hand side of equation (12) yields the value 1 independently of setpoint value $Q_{b,soll}$. The defining equation for correction factor x follows as a function of arterial underpressure $P_{art}$:

$$b_2 * P^2_{art} * x^3 + b_1 * P_{art} * x^2 - x + 1 = 0 \quad \text{equation (13)}$$

Computing unit 18 calculates correction factor x according to equation (13) from arterial underpressure $P_{art}$ ascertained at preset speed $n_{alt}$. After the determination of correction factor x, computing unit 18 calculates speed $n_{neu}$ according to equation (11) by multiplying speed $n_{alt}$, preset by control unit 15, by correction factor x, said speed $n_{neu}$ being set by control unit 15 in order to match effective delivery rate $Q_{b,ist}$ (effective blood flow) to desired delivery rate $Q_{b,soll}$ (blood flow).

Since the solving of equation (13) during the running time is very expensive, an alternative embodiment of the invention makes provision to store the relationship between arterial underpressure $P_{art}$ and correction factor x in a value table, which is compiled in advance and stored in memory 22. In this embodiment, computing unit 18 takes correction factor x belonging to ascertained arterial underpressure $P_{art}$ directly from memory 22, without solving equation (13) in real time.

FIG. 3 shows that, upon selection of new speed $n_{neu}$, a new arterial underpressure $P_{art,neu}$ results, at which the effective delivery rate of the blood pump $Q_{b,ist,neu}$ (blood flow) is equal to desired delivery rate $Q_{b,soll}$ (blood flow).

At running time t, the setpoint value will diverge from the actual value of the blood pump without further compensation. The device according to example embodiments the present invention therefore provides a continuous control of the speed of pump 14 by means of further compensation steps. The theoretical principles of the continuous control are next described:

Whereas the initial compensation step may be carried out only after starting the blood pump without compensation, equation (6) is no longer satisfied after the initial compensation step, and correction factor x is dependent on the ratio of desired delivery rate $Q_{b,soll}$ (blood flow) to actual speed $n_{art}$.

Equation (12) is reduced to equation (13), whereby the following is defined for the left-hand side of equation (12):

$$q = \frac{Q_{b,soll}}{n_{alt} * V_{S,0}(r) * (1 - a_1 * t)} \quad \text{equation (14)}$$

If equation (12) is divided by equation (14), the following equation, which is formally identical to equation (13), is obtained:

$$b_2 * P^2_{art,r} * x^3_r + b_1 * P_{art,r} * x^2_r - x_r + 1 = 0 \quad \text{equation (15)}$$

where $P_{art,r} = q * P_{art}$ equation (15a) and $x_r = x/q$ equation (15b).

In order to be able to use the table stored in memory 22, which in each case assigns a correction factor $x_r$ to an arterial underpressure $P_{art}$ according to equation (13), a reduced correction factor $x_r$ is determined for a reduced arterial underpressure $P_{art,r}$. For this purpose, computing unit 18 first calculates ratio q between reduced correction factor $x_r$ and correction factor x according to equation (14). Speed $n_{alt}$ is the speed instantaneously preset by control unit 15 after the initial compensation step. By multiplying arterial underpressure $P_{art}$ measured by pressure sensor 20 by factor q, the computing unit calculates reduced arterial pressure $P_{art,r}$ according to equation (15a). The computing unit then takes, from the table stored in memory 22, the value of reduced correction factor $x_r$ that is assigned to reduced arterial underpressure $P_{art,r}$. After reduced correction factor $x_r$ and factor q are determined, computing unit 18 calculates speed $n_{neu}$ to be set by control unit 15 from:

$$n_{neu}=x_r*n_{alt} \quad \text{equation (16)}$$

Control unit 15 sets new speed $n_{neu}$, so that the actual value of the delivery rate is again matched to the setpoint value. The next iterative compensation step then follows, whereby factor q is first calculated again at speed $n_{alt}$ now set by control unit 15, which speed $n_{alt}$ corresponds to new speed $n_{neu}$ determined in the preceding compensation step.

The essential correction is achieved in the initial compensation step. Consequently, it would in principle also be possible to dispense with the following control. Only smaller deviations are as a rule eliminated in the continuous control, whereby the amount of the maximum change per iteration is limited to 2% for an arterial underpressure ≦150 mmHg and to 4% for an arterial underpressure ≧150 mmHg.

The invention claimed is:

1. A method for determining and adjusting the effective delivery rate of a peristaltic pump, with which liquid is delivered in an elastic hose pipe, the pump having a nominal speed, a stroke volume, and a running time, comprising:

determining the pressure in the hose pipe upstream of the pump and the nominal speed of the pump;

calculating the effective delivery rate on the basis of the nominal speed of the pump and the pressure in the hose pipe upstream of the pump, wherein the calculation of the effective delivery rate takes place on the basis of the nominal speed of the pump and the pressure in the hose pipe upstream of the pump in dependence on the running time of the pump, the calculating including multiplying the stroke volume of the pump by the nominal speed of the pump, and correcting the product of the stroke volume and the nominal speed of the pump by a correction function describing the dependence of the stroke volume of the pump on its running time and the pressure in the hose pipe upstream of the pump in order to determine the effective delivery rate;

determining a correction factor for the nominal pump speed that corresponds to a change of the effective delivery rate from the calculated delivery rate to a predetermined desired delivery rate; and changing the effective delivery rate to the desired delivery rate by adjusting the nominal pump speed to an adjusted speed determined by multiplying the determined nominal speed by the correction factor.

2. The method according to claim 1, wherein, as a correction function, a polynomial with one or more parameters is set up to describe the relative decrease in the nominal delivery rate with the running time of the pump and a polynomial with one or more parameters is set up to describe the relative decrease in the nominal delivery rate with the pressure in the hose pipe upstream of the pump.

3. The method according to claim 2, wherein the polynomials are described by the following equation:

$$V_s=V_{s,0}(r)*(1-a_1*t)*(1-b_1*P_{art}-b_2*P^2_{art})$$

where t is the running time of the pump, $P_{art}$ is the pressure in the hose pipe upstream of the pump, $V_{s,0}(r)$ is the stroke volume after a specific running time with zero pressure at the entrance of the blood pump, $a_1$ is a parameter which describes the relative decrease in the delivery rate with the running time, and $b_1$ and $b_2$ are parameters which describe the relative decrease in the delivery rate with arterial underpressure.

4. A device for determining and adjusting the effective delivery rate of a peristaltic pump, with which liquid is delivered in an elastic hose pipe, the pump having a nominal speed, a stroke volume, and a running time, comprising:

means for measuring the pressure in the hose pipe upstream of the pump, means for determining the nominal speed of the pump, means for calculating the effective delivery rate on the basis of the nominal speed of the pump and the pressure in the hose pipe upstream of the pump, wherein the means for calculating the effective delivery rate are configured in such a way that the effective delivery rate is calculated on the basis of the nominal speed of the pump and the pressure in the hose pipe upstream of the pump in dependence on the running time of the pump, the means for calculating the effective delivery rate including means for multiplying the stroke volume by the nominal speed of the pump, and means for correcting the product of the stroke volume and the nominal speed of the pump with a correction function describing the dependence of the stroke volume of the pump on its running time and the pressure in the hose pipe upstream of the pump;

means for determining a correction factor for the nominal pump speed that corresponds to a change of the effective delivery rate from the calculated delivery rate to a predetermined desired delivery rate; and means for changing the effective delivery rate to the desired delivery rate by adjusting the nominal speed of the pump from a first speed to a second speed determined by multiplying the first speed by the correction factor.

5. The device according to claim 4, wherein the means for correcting are configured in such a way that, as a correction function, a polynomial with one or more parameters is set up to describe the relative decrease in the nominal delivery rate with the running time of the pump and a polynomial with one or more parameters is set up to describe the relative decrease in the nominal delivery rate with the pressure in the hose pipe upstream of the pump.

6. The device according to claim 5, wherein the polynomials are described by the following equation:

$$V_s=V_{s,0}(r)*(1-a_1*t)*(1-b_1*P_{art}-b_2*P^2_{art})$$

where t is the running time of the pump, $P_{art}$ is the pressure in the hose pipe upstream of the pump, $V_{s,0}(r)$ is the stroke volume after a specific running time with zero pressure at the entrance of the blood pump, $a_1$ is a parameter which describes the relative decrease in the delivery rate with the running time, and $b_1$ and $b_2$ are parameters which describe the relative decrease in the delivery rate with arterial underpressure.

7. The device according to claim 4, wherein the peristaltic pump is one of a roller pump and a finger pump.

8. A method for adjusting the speed of a peristaltic pump, with which liquid is delivered in an elastic hose pipe, the pump having a nominal speed, a running time, and a delivery rate, comprising:

determining the pressure in the hose pipe upstream of the pump and the nominal speed of the pump;

determining a correction factor x for a nominal pump speed $n_{alt}$ that corresponds to a change of an effective delivery rate $Q_{b,ist}$ of the pump to a predetermined desired delivery rate $Q_{b,soll}$;

matching the effective delivery rate to the desired delivery rate of the pump by adjusting the nominal speed of the pump, wherein the matching of the effective delivery rate of the pump to the desired delivery rate takes place on the basis of the nominal speed of the pump and the pressure in the hose pipe upstream of the pump in dependence on the running time of the pump; and performing a first compensation step, wherein a speed $n_{neu}$, with which the pump is operated in order to match an effective delivery rate $Q_{b,ist}$ of the pump to the desired delivery rate $Q_{b,soll}$, is calculated by multiplying the nominal speed $N_{alt}$ of the pump by the correction factor x.

9. The method according to claim 8, wherein the nominal speed $n_{alt}$ of the pump is adjusted before the first compensation step.

10. The method according to claim 9, wherein the pump is operated at a preset speed $n_{alt}$ in order to determine the correction factor x, whereby a pressure $P_{art}$ that is established at the preset speed is measured in the hose pipe upstream of the pump.

11. The method according to claim 10, wherein the preset speed $n_{alt}$ with which the pump is operated in order to determine the pressure $P_{art}$ in the hose pipe, is calculated according to the following equation:

$$n_{alt} = \frac{Q_{b,soll}}{V_{S,0}(r) * (1 - a_1 * t)}$$

where $V_{s,0}(r)$ is the stroke volume after a specific running time with zero pressure at the entrance of the blood pump, $a_1$ is a parameter which describes the relative decrease in the delivery rate when the running time is at a value of t.

12. The method according to claim 11, wherein the delivery rate of the pump is controlled after the first compensation step.

13. The method according to claim 12, wherein the speed $n_{neu}$, with which the pump is operated in order to match the effective delivery rate of the pump to the desired delivery rate, is calculated by multiplying the nominal speed $n_{alt}$ of the pump adjusted after the first compensation step by a correction factor x in order to control the delivery rate of the pump in a further compensation step.

14. The method according to claim 13, wherein the delivery rate of the pump is continuously controlled in successive iterative compensation steps.

15. A method for adjusting the speed of a peristaltic pump, with which liquid is delivered in an elastic hose pipe, the pump having a nominal speed, a running time, and a delivery rate, comprising:

determining the pressure in the hose pipe upstream of the pump and the nominal speed of the pump;

matching the effective delivery rate to the desired delivery rate of the pump by adjusting the nominal speed of the pump, wherein the matching of the effective delivery rate of the pump to the desired delivery rate takes place on the basis of the nominal speed of the pump and the pressure in the hose pipe upstream of the pump in dependence on the running time of the pump; and performing a first compensation step, wherein a speed $n_{neu}$, with which the pump is operated in order to match an effective delivery rate $Q_{b,ist}$ of the pump to a desired delivery rate $Q_{b,soll}$, is calculated by multiplying the nominal speed $n_{alt}$ of the pump adjusted before the first compensation step by a correction factor x, wherein the pump is operated at a preset speed $n_{alt}$ in order to determine the correction factor x, whereby a pressure $P_{art}$ that is established at the preset speed is measured in the hose pipe upstream of the pump, wherein the preset speed $n_{alt}$, with which the pump is operated in order to determine the pressure $P_{art}$ in the hose pipe, is calculated according to the following equation:

$$n_{alt} = \frac{Q_{b,soll}}{V_{S,0}(r) * (1 - a_1 * t)}$$

where $V_{s,0}(r)$ is the stroke volume after a specific running time with zero pressure at the entrance of the blood pump, $a_1$ is a parameter which describes the relative decrease in the delivery rate when the running time is at a value of t, and wherein the correction factor x is determined from the pressure $P_{art}$ established at the preset speed $n_{alt}$ in the hose pipe upstream of the pump according to the following equation:

$$b_2 * P^2_{art} * x^3 + b_1 * P_{art} * x^2 - x + 1 = 0.$$

16. A method for adjusting the speed of a peristaltic pump, with which liquid is delivered in an elastic hose pipe, the pump having a nominal speed, a running time, and a delivery rate, comprising:

determining the pressure in the hose pipe upstream of the pump and the nominal speed of the pump;

matching the effective delivery rate to the desired delivery rate of the pump by adjusting the nominal speed of the pump, wherein the matching of the effective delivery rate of the pump to the desired delivery rate takes place on the basis of the nominal speed of the pump and the pressure in the hose pipe upstream of the pump in dependence on the running time of the pump; and performing a first compensation step, wherein a speed $n_{neu}$, with which the pump is operated in order to match an effective delivery rate $Q_{b,ist}$ of the pump to a desired delivery rate $Q_{b,soll}$, is calculated by multiplying the nominal speed $n_{alt}$ of the pump adjusted before the first compensation step by a correction factor x, wherein the pump is operated at a preset speed $n_{alt}$ in order to determine the correction factor x, whereby a pressure $P_{art}$ that is established at the preset speed is measured in the hose pipe upstream of the pump, wherein the preset speed $n_{alt}$, with which the pump is operated in order to determine the pressure $P_{art}$ in the hose pipe, is calculated according to the following equation:

$$n_{alt} = \frac{Q_{b,soll}}{V_{S,0}(r) * (1 - a_1 * t)}$$

where $V_{s,0}(r)$ is the stroke volume after a specific running time with zero pressure at the entrance of the blood pump, and $a_1$ is a parameter which describes the relative decrease in the delivery rate when the running time is at a value of t, wherein the delivery rate of the pump is controlled after the first compensation step, wherein the speed $n_{neu}$, with which the pump is operated in order to match the effective delivery rate of the pump to the desired delivery rate, is calculated by multiplying the nominal speed $n_{alt}$ of the pump adjusted after the first compensation step by a correction factor x in order to control the delivery rate of the pump in a further compensation step, and wherein, in order to determine the correction factor x, a ratio q of the correction factor x ascertained in the further compensation step and a reduced correction factor $x_r$ is determined according to the following equation:

$$q = \frac{Q_{b,soll}}{n_{alt} * V_{S,0}(r) * (1 - a_1 * t)} = x / x_r$$

17. The method according to claim 16, wherein a reduced pressure $P_{art,r}$ in the hose pipe upstream of the pump is calculated by multiplying the pressure measured in the hose pipe upstream of the pump by the ratio q of the correction factor x to the reduced correction factor $x_r$, whereby the reduced correction factor $x_r$ is calculated from reduced pressure $P_{art,r}$ according to the following equation:

$$b_2 * P^2_{art} * x^3_r + b_1 * P_{art,r} * x^2_r - x_r + 1 = 0.$$

18. The method according to claim 17, wherein the correction factor x is calculated by multiplying the reduced correction factor $x_r$ by the ratio q of the correction factor x to the reduced correction factor $x_r$.

19. A device for adjusting the speed of a peristaltic pump, with which liquid is delivered in an elastic hose pipe, the pump having a nominal speed, a running time, and an effective delivery rate, comprising:

means for determining the pressure in the hose pipe upstream of the pump and the nominal speed of the pump and means for matching the effective delivery rate to a desired delivery rate of the pump, the means for matching comprising a computing unit configured to calculate an adjusted speed and means for adjusting the nominal speed of the pump to the adjusted speed, wherein the computing unit is configured to:

calculate the adjusted speed, in order to match the effective delivery rate of the pump to the desired delivery rate, based on the nominal speed of the pump and the pressure in the hose pipe upstream of the pump in dependence on the running time of the pump, determine a correction factor x for a nominal pump speed $n_{alt}$ that corresponds to a change of an effective delivery rate $Q_{b,ist}$ of the pump to a predetermined desired delivery rate $Q_{b,soll}$, and perform a first compensation step in which a speed $n_{neu}$ with which the pump is operated in order to match the effective delivery rate $Q_{b,ist}$ of the pump to the desired delivery rate $Q_{b,soll}$ is calculated by multiplying the nominal speed $n_{alt}$ of the pump by a correction factor x.

20. The device according to claim 19, wherein the nominal speed is adjusted before the first compensation step.

21. The device according to claim 20, wherein the computing unit is configured in such a way that the pump is operated at a preset speed in order to determine the correction factor x, whereby the pressure that is established at the preset speed is measured in the hose pipe upstream of the pump.

22. The device according to claim 21, wherein the computing unit is configured in such a way that the preset speed $n_{alt}$, with which the pump is operated in order to determine arterial pressure $P_{art}$ in the hose pipe, is calculated according to the following equation:

$$n_{alt} = \frac{Q_{b,soll}}{V_{S,0}(r) * (1 - a_1 * t)}$$

where $V_{s,0}(r)$ is a stroke volume after a specific period of the running time with zero pressure at the entrance of the blood pump, and $a_1$ is a parameter which describes the relative decrease in the effective delivery rate with the running time having a value t.

23. The device according to claim 20, wherein the means for matching the effective delivery rate to the desired delivery rate of the pump are configured in such a way that the delivery rate of the pump is controlled after the first compensation step.

24. The device according to claim 23, wherein the computing unit is configured in such a way that a speed $n_{neu}$, with which the pump is operated in order to match the effective delivery rate of the pump to the desired delivery rate, is calculated by multiplying a nominal speed value $n_{alt}$ of the pump, the nominal speed value $n_{alt}$ adjusted after the first compensation step, by a correction factor x in order to control the delivery rate of the pump in a further compensation step.

25. The device according to claim 19, wherein the peristaltic pump is one of a roller pump and a finger pump.

26. A blood treatment apparatus including a device according to claim 19.

27. A device for adjusting the speed of a peristaltic pump, with which liquid is delivered in an elastic hose pipe, the pump having a nominal speed, a running time, and an effective delivery rate, comprising:

means for determining the pressure in the hose pipe upstream of the pump and the nominal speed of the pump and means for matching the effective delivery rate to a desired delivery rate of the pump, the means for matching comprising a computing unit configured to calculate an adjusted speed and means for adjusting the nominal speed of the pump to the adjusted speed, wherein the computing unit is configured in such a way that the calculation of the adjusted speed, in order to match the effective delivery rate of the pump to the desired delivery rate, takes place on the basis of the nominal speed of the pump and the pressure in the hose pipe upstream of the pump in dependence on the running time of the pump, wherein the computing unit is configured in such a way that, in a first compensation step, a speed $n_{neu}$, with which the pump is operated in order to match the effective delivery rate $Q_{b,ist}$ of the pump to the desired delivery rate $Q_{b,soll}$, is calculated by multiplying the nominal speed $n_{alt}$ of the pump, the nominal speed being adjusted before the first compensation step, by a correction factor x, wherein the computing unit is configured in such a way that the pump is operated at a preset speed in order to determine the correction factor x, whereby the pressure that is established at the preset speed is measured in the hose pipe upstream of the pump, wherein the computing unit is configured in such a way that the preset speed $N_{alt}$, with which the pump is operated in order to determine arterial pressure $P_{art}$ in the hose pipe, is calculated according to the following equation:

$$n_{alt} = \frac{Q_{b,soll}}{V_{S,0}(r) * (1 - a_1 * t)}$$

where $V_{s,0}(r)$ is a stroke volume after a specific period of the running time with zero pressure at the entrance of the blood pump, and $a_1$ is a parameter which describes the relative decrease in the effective delivery rate with the running time having a value t, and wherein the computing unit is configured in such a way that the correction factor x is determined from a pressure $P_{art}$ established at the preset speed $n_{alt}$ in the hose pipe upstream of the pump according to the following equation:

$$b_2 * P^2_{art} * x^3 + b_1 * P_{art} * x^2 - x + 1 = 0.$$

28. A device for adjusting the speed of a peristaltic pump, with which liquid is delivered in an elastic hose pipe, the pump having a nominal speed, a running time, and an effective delivery rate, comprising:

means for determining the pressure in the hose pipe upstream of the pump and the nominal speed of the pump and means for matching the effective delivery rate to a desired delivery rate of the pump, the means for matching comprising a computing unit configured to calculate an adjusted speed and means for adjusting the nominal speed of the pump to the adjusted speed, wherein the computing unit is configured in such a way that the calculation of the adjusted speed, in order to match the effective delivery rate of the pump to the desired delivery rate, takes place on the basis of the nominal speed of the pump and the pressure in the hose pipe upstream of the pump in dependence on the running time of the pump, wherein the computing unit is configured in such a way that, in a first compensation step, a speed $n_{neu}$, with which the pump is operated in order to match the effective delivery rate $Q_{b,ist}$ of the pump to the desired delivery rate $Q_{b,soll}$, is calculated by multiplying the nominal speed $n_{alt}$ of the pump, the nominal speed being adjusted before the first compensation step, by a correction factor x, wherein the means for matching the effective delivery rate to the desired delivery rate of the pump are configured in such a way that the delivery rate of the pump is controlled after the first compensation step, wherein the computing unit is configured in such a way that a speed $n_{neu}$, with which the pump is operated in order to match the effective delivery rate of the pump to the desired delivery rate, is calculated by multiplying a nominal speed value $n_{alt}$ of the pump, the nominal speed value $n_{alt}$ adjusted after the first compensation step, by a correction factor x in order to control the delivery rate of the pump in a further compensation, and wherein the computing unit is configured in such a way that, in order to determine the correction factor x, a ratio q of the correction factor x ascertained in the compensation step and a reduced correction factor $x_r$ is determined according to the following equation:

$$q = \frac{Q_{b,soll}}{n_{alt} * V_{S,0}(r) * (1 - a_1 * t)} = x / x_r$$

29. The device according to claim 28, wherein the computing unit is configured in such a way that a reduced pressure $P_{art,r}$ in the hose pipe upstream of the pump is calculated by multiplying the pressure measured in the hose pipe upstream of the pump by the ratio q of the correction factor x to the reduced correction factor $x_r$, whereby the reduced correction factor $x_r$ is calculated from reduced pressure $P_{art,r}$ according to the following equation:

$$b_2 * P^2_{art,r} * x^3_r + b_1 * P_{art,r} * x^2_r - x_r + 1 = 0.$$

30. The device according to claim 29, wherein the computing unit is configured in such a way that the correction factor $x_r$ is calculated by multiplying the reduced correction factor $x_r$ by the ratio q of the correction factor x to the reduced correction factor $x_r$.

* * * * *